US009403263B2

(12) United States Patent
Lai

(10) Patent No.: US 9,403,263 B2
(45) Date of Patent: Aug. 2, 2016

(54) OIL FILTER WRENCH

(71) Applicant: Chiu-Chi Lai, Taichung (TW)

(72) Inventor: Chiu-Chi Lai, Taichung (TW)

( * ) Notice: Subject to any disclaimer, the term of this patent is extended or adjusted under 35 U.S.C. 154(b) by 253 days.

(21) Appl. No.: 14/243,538

(22) Filed: Apr. 2, 2014

(65) Prior Publication Data

US 2015/0283686 A1 Oct. 8, 2015

(51) Int. Cl.
*B25B 27/00* (2006.01)
*B25B 13/50* (2006.01)
*B25B 13/46* (2006.01)

(52) U.S. Cl.
CPC ..... *B25B 27/0042* (2013.01); *B25B 13/463* (2013.01); *B25B 13/505* (2013.01)

(58) Field of Classification Search
CPC .. B25B 27/0042; B25B 13/463; B25B 17/00; B25B 13/505; B25B 13/5075
USPC ..... 81/60–63.2
See application file for complete search history.

(56) References Cited

U.S. PATENT DOCUMENTS 453,667 A * 6/1891 Sargent, Jr. ..... B25B 15/04 74/577 R
3,575,069 A * 4/1971 White ..... B25G 1/005 81/177.2
5,461,950 A * 10/1995 Iwinski ..... B25G 1/063 81/61
6,880,432 B2 * 4/2005 Hsieh ..... B25B 13/463 192/43.2
8,490,518 B2 * 7/2013 Chen ..... B25B 27/0042 81/3.44
2009/0217789 A1 * 9/2009 Chang ..... B25B 13/465 81/60
2012/0079919 A1 * 4/2012 Chen ..... B25B 27/0042 81/90.2

* cited by examiner

*Primary Examiner* — Hadi Shakeri

(57) ABSTRACT

An oil filter wrench includes a base, a main rotating body, a ratcheting drive portion, a limiting mechanism, at least three rotating members and at least three claws. The main rotating portion is rotatably assembled with the body including a drive portion operable from outside. The ratcheting drive portion includes a ratcheting disk rotatably mounted with the main rotating portion and a main gear engaged with the ratcheting disk. The limiting mechanism includes at least one ratcheting member movably disposed on the main rotating body and including at least one tooth selectively engaged with the ratcheting disk. The rotating members axially pivoted to the base are arranged around an axis of the base. Each rotating member includes a passive gear portion engaged with the main gear and rotatable about a central axis. The claws connected to the rotating members are movable around corresponding central axis respectively.

10 Claims, 7 Drawing Sheets

OIL FILTER WRENCH

BACKGROUND OF THE INVENTION

1. Field of the Invention

The present invention relates to a wrench, and more particularly to an oil filter wrench.

2. Description of the Prior Art

It is quite common to use a vehicle nowadays, the vehicle relies on mechanism working while moving and oil is for lubricating the mechanism. The oil contains some metal chips after it lubricates the mechanism. An oil filter is for filtering the metal chips. The oil filter blocks and becomes invalid when it accumulates a specific mass of metal chips. So it is necessary to replace the oil filter regularly. An oil filter wrench is for clamping the oil filter. In order to disassemble the oil filter in different kind of dimensions, the oil filter wrench is provided with an adjustable function for adjusting the clamping dimension. An operator uses a hand tool to turn the operating portion on the oil filter wrench and clamp the oil filter tightly. This kind of oil filter wrench is disclosed in TWM448416, TWM401512 and so on.

However, though the oil filter wrench known as before is able to disassemble the oil filter in different kind of dimensions, but the operating portion on the oil filter wrench is only rotatable in one direction. If rotating the hand tool in a tiny space and it is unable to rotate the hand tool without an obstruction lying in the way, it is necessary to pull up the hand tool after a short distance and rotate it reversely, and then rotate the operating portion by the hand tool again, continuously. It is highly affected in working efficiency, and this disadvantage is needed to be improved.

The present invention has arisen to mitigate and/or obviate the afore-described disadvantages.

SUMMARY OF THE INVENTION

The primary object of the present invention is to provide an oil filter wrench which includes a ratcheting structure. By using driving and blocking functions of the ratcheting structure, it only needs to hold a hand tool and reciprocally rotate the oil filter wrench to clamp the oil filter.

Besides, after the oil filter wrench clamps the oil filter, the operator continues to reciprocally rotate the hand tool to release the oil filter and detach it from an oil filter container. There is no need to worry that the oil filter wrench is unable to clamp the oil filter when the hand tool is rotated reversely and that the oil filter wrench has to be rotated to clamp the oil filter again.

To achieve the above object, an oil filter wrench in accordance with present invention includes a base, a main rotating body, a ratcheting drive portion, a limiting mechanism, at least three rotating members and at least three claws. The main rotating portion is rotatably assembled with the base and includes a drive portion operable from outside. The ratcheting drive portion includes a ratcheting disk rotatably mounted with the main rotating portion and a main gear engaged with the ratcheting disk. The limiting mechanism includes at least one ratcheting member movably disposed on the main rotating body and including at least one tooth selectively engaged with the ratcheting disk. The at least three rotating members axially pivoted to the base are arranged around an axis of the base. Each rotating member includes a passive gear portion engaged with the main gear and rotatable about a central axis.

The at least three claws connected to the rotating members are movable around corresponding central axis respectively.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
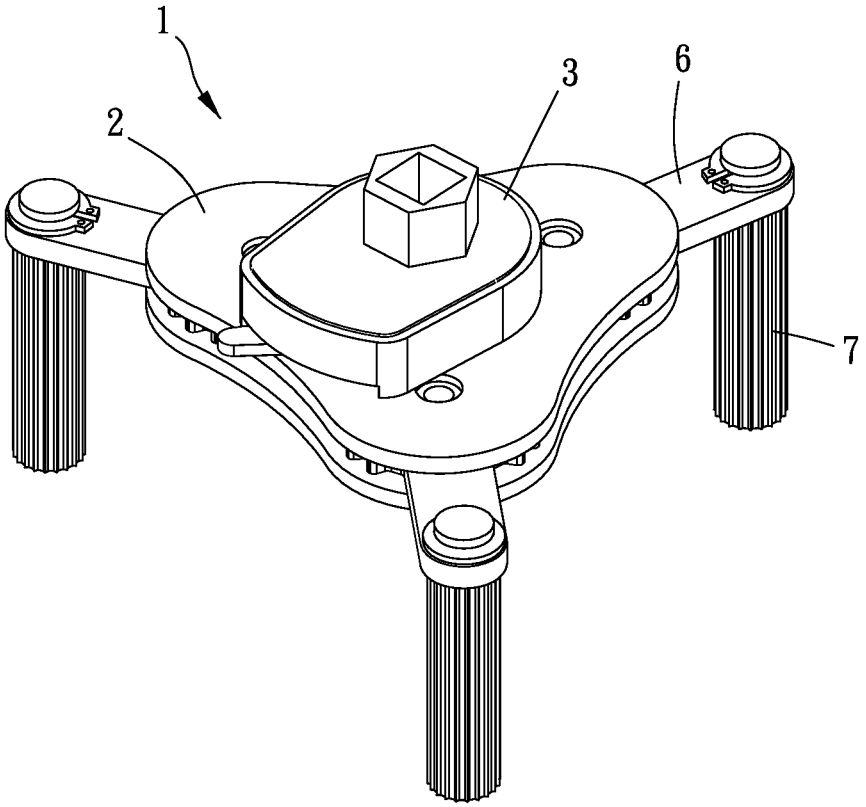
FIG. 1 is a perspective drawing showing a first embodiment of the present invention.
Figure 2:
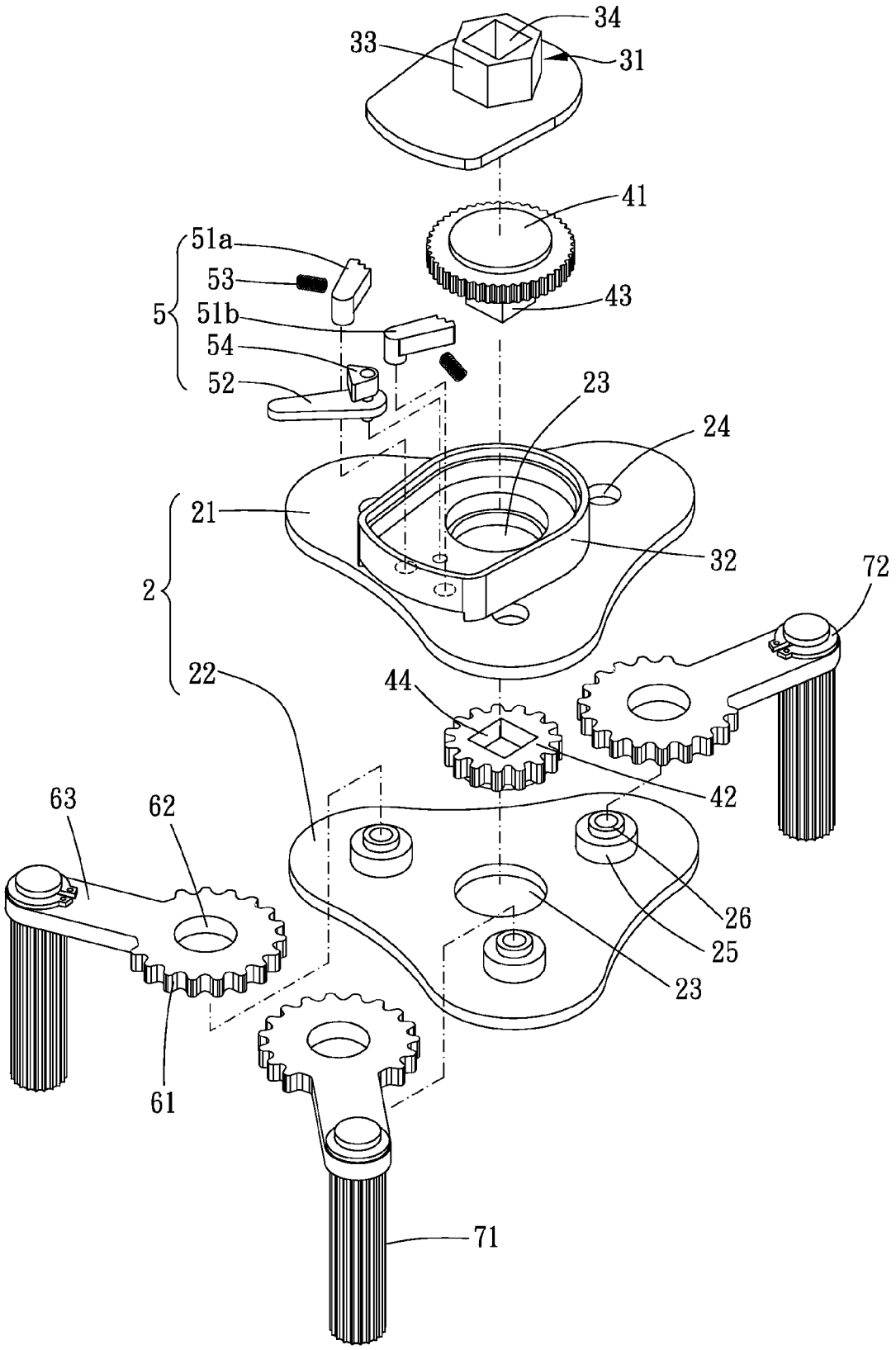
FIG. 2 is a breakdown drawing of the first embodiment of the present invention.
Figure 3:
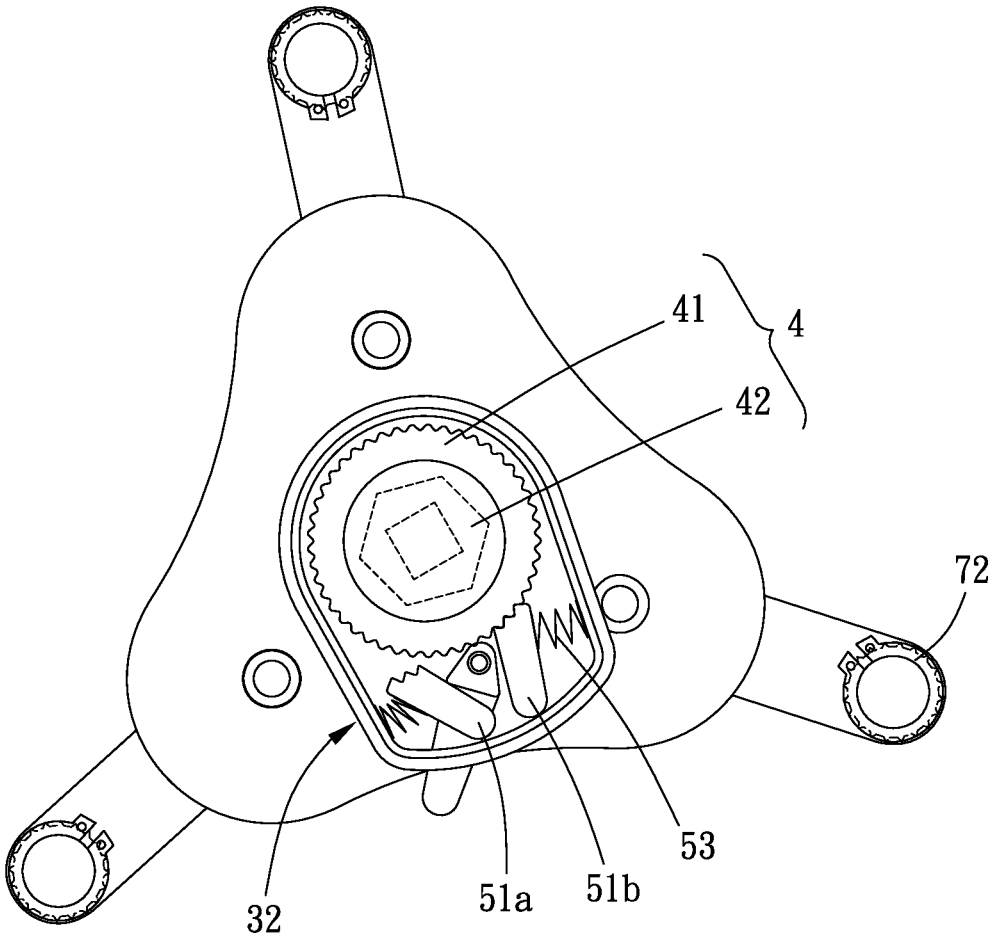
FIG. 3 is a look-down drawing of the first embodiment of the present invention.

Referring to FIGS. 1-3, an oil filter wrench 1 includes a base 2, a main rotating body 3, a ratcheting drive portion 4, a limiting mechanism 5, at least three rotating members 6 and at least three claws 7.

The base 2 includes a top plate 21 and a bottom plate 22, and either of the top plate 21 and the bottom plate 22 has a central through hole 23. The base 2 has an axis, and the axis is defined to penetrate through the central through hole 23 and perpendicular to the top plate 22 and the bottom plate 23. The top plate 21 includes at least three circular holes 24, and the bottom plate 22 is formed with at least three fixation portions 25. Each of the fixation portions 25 is formed with at least three projecting rings 26 whose dimensions correspond to the dimensions of the circular holes 24. Specifically, the circular holes 24 of the top plate 21 are disposed respectively around the projecting rings 26 of the bottom plate 22.

The main rotating body 3 is rotatably assembled with the base 2. The main rotating body 3 includes a drive portion 31 operable from outside and a housing 32 formed with the drive portion 31. In this embodiment, the drive portion 31 includes a polygonal protrusion 33 and a polygonal concavity 34 disposed on the polygonal protrusion 33. In other embodiments, the driver portion 31 may include only the polygonal protrusion 33 or only the polygonal concavity 34. The drive portion 31 is operable from outside of the base 2 by using a tool matching the structure of the drive portion 31.

The ratcheting drive portion 4 includes a ratcheting disk 41 rotatably mounted with the main rotating body 3 and a main gear 42 engaged with the ratcheting disk 41. Specifically, the main gear 42 is disposed outside the housing 32 and the ratcheting disk 41 is disposed inside the housing 32. The top plate 21 of the base 2 is between the main gear 42 and the housing 32. The ratcheting drive portion 4 includes a first assembling portion 43 axially extending from the ratcheting disk 41. The main gear 42 is formed with a second assembling portion 44 connected with the first assembling portion 43.

The first assembling portion 43 penetrates through the central through hole 23 of the top plate 21 and is connected with the second assembling portion 44, so that the ratcheting disk 41 and the main gear 42 are co-movable.

The limiting mechanism 5 includes at least one ratcheting disk movably disposed on the main rotating body 3 and a switching member 52. Preferably, the limiting mechanism 5 includes at least one first elastic member 53 disposed between the main rotating body 3 and the at least one ratcheting member. The number of the ratcheting members is two in this embodiment, and the ratcheting members are disposed on and inside the housing 32. Each of the ratcheting members includes at least one tooth selectively engaged with the ratcheting disk 41. Specifically, the two ratcheting members include a first ratcheting member 51*a* and a second ratcheting member 51*b* respectively, and the switching member 52 is pivotally mounted to the main rotating body 3 and formed with an abutting block 54 between the first ratcheting member 51*a* and the second ratcheting member 51*b*. The switching member 52 is pivotable between a first position and a second position.

The at least three rotating members 6 are axially pivoted to the base 2 and arranged around the axis of the base 2. Each of the rotating members 6 includes a passive gear portion 61 engaged with the main gear 42. Each of the passive gear portions 61 is formed with a fixation hole 62 disposed around the at least three fixation portions 25 respectively. Each of the passive gear portions is rotatable about a central axis. When the main gear 42 rotates, each of the rotating members 6 is driven by the main gear 42 and rotates relatively. Each of the rotating members 6 includes an arm 63 radially extending from the passive gear portion 61 in this embodiment.

Each of the claws 7 is connected to corresponding arm 63 of the rotating member 6 on the top and rotatable about corresponding central axis. Each of the claws 7 is formed with a plurality of long troughs 71, and the structure of the long troughs 71 is for increasing the friction between the claws 7 and the oil filter (not shown), so that the oil filter is clamped tightly. The claws 7 are detachable and replaceable. Specifically, each of the claws 7 is formed with a circular groove on the top (not shown). When the claw 7 is inserted into the rotating member 6, and the circular groove is buckled by a c-shaped retainer 72. The c-shaped retainer 72 locks the claw 7, and the claw 7 is releasably attached to the rotating member 6. The claw 7 can be disassembled if the c-shaped retainer is removed. This design is convenient for replacing and maintaining the claw 7.

Figure 4:
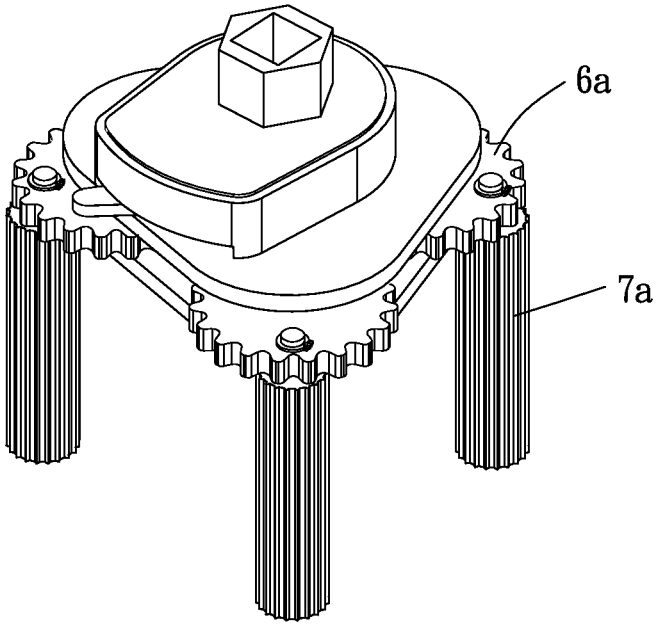
FIG. 4 is a perspective drawing showing a second embodiment of the present invention.

A second embodiment is shown in FIG. 4. Each of rotating members 6*a* is formed without an arm. Specifically, each of the rotating members 6*a* is a complete gear. Each of the claws 7*a* is connected to the rotating member 6*a* directly.

Figure 5:
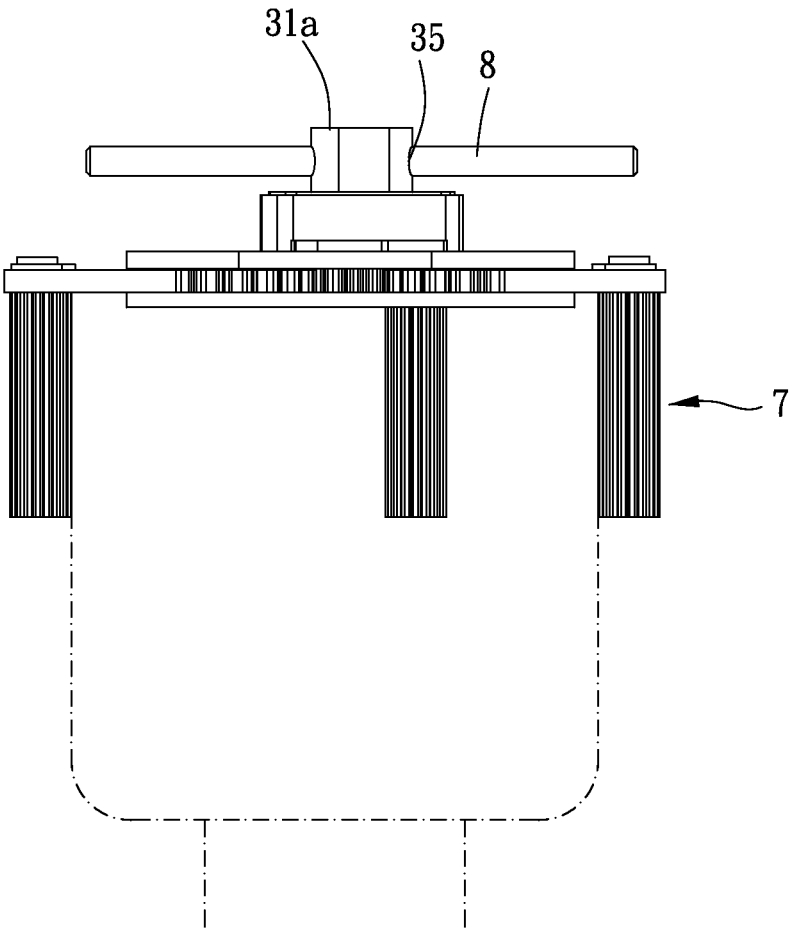
FIG. 5 is a perspective drawing showing a third embodiment of the present invention.
Figure 6:
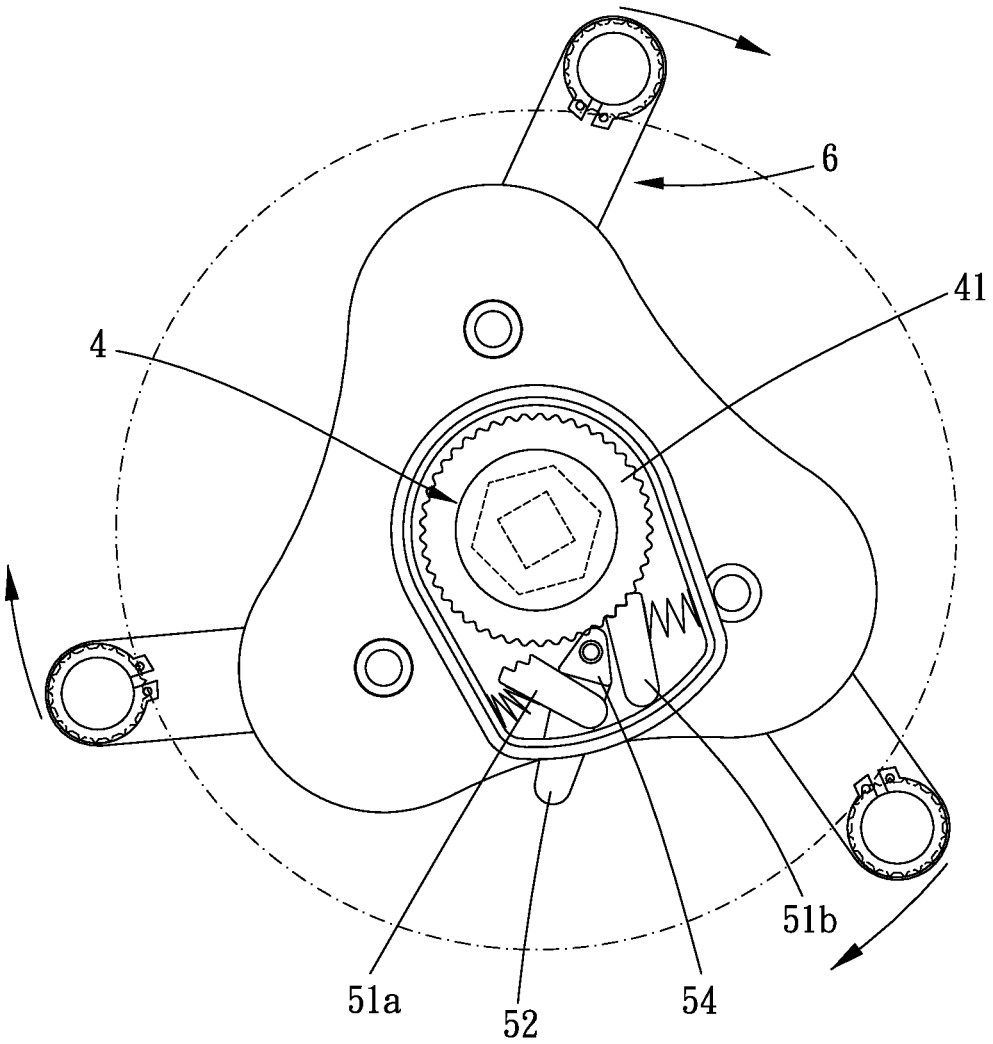
FIG. 6 is a drawing showing the first embodiment of the present invention in use.
Figure 7:
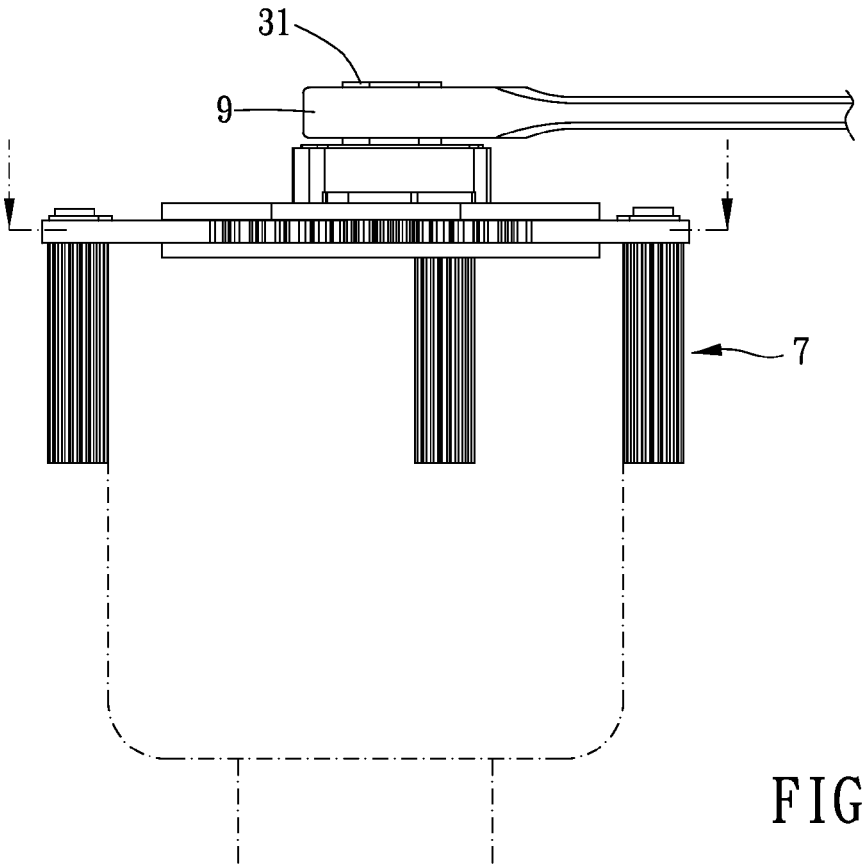
FIG. 7 is a side view showing the first embodiment of the present invention in use.
Figure 8:
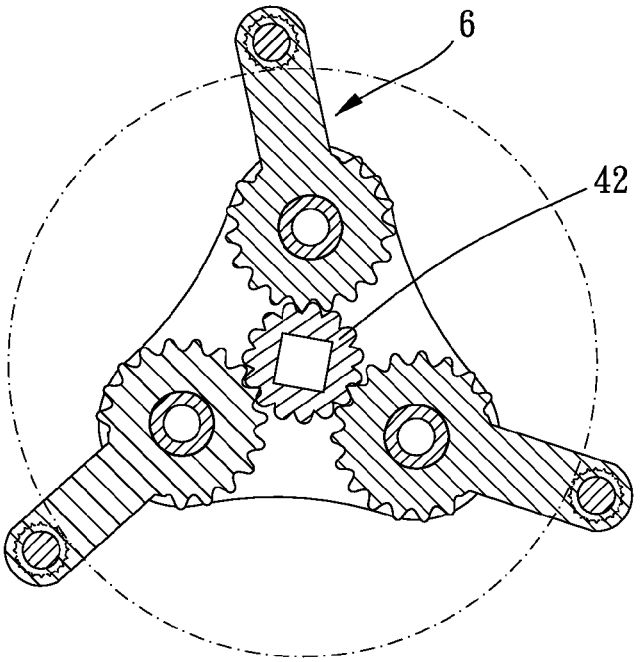
FIG. 8 is a cross-sectional drawing showing the first embodiment of the present invention in use.

A third embodiment is shown in FIG. 5. A drive portion 31*a* includes a radial through hole 35. The through hole 35 is for insertion of a driving shaft 8, and the drive portion 31*a* can be rotated by driving the driving shaft 8.

Please refer to FIGS. 1 and 6-8 where the first preferable embodiment of the present invention is taken as an example. In this embodiment, when the switching member 52 is located in the first position, the abutting block 54 abuts against the first ratcheting member 51*a* so that the first ratcheting member 51*a* is unengaged with the ratcheting disk 41 and the second ratcheting member 51*b* is engaged with the ratcheting disk 41. When the drive portion 31 is rotated in a first rotating direction by using a tool 9 matching the drive portion 31, the ratcheting disk 41 is unrotatable, and relatively to the ratcheting drive portion 4 the main rotating body 3 is only rotatable in the first rotating direction (as indicated by the arrow shown in FIG. 6). When the drive portion 31 is rotated in a second rotating direction opposite to the first rotating direction, the ratcheting disk 41 is engaged with the second ratcheting member 51*b* to drive the main gear 42 to rotate.

It is noted that when the switching member 52 is located in the second position, the abutting block 54 abuts against the second ratcheting member 51*b* so that the second ratcheting member 51*b* is unengaged with the ratcheting disk 41 and the first ratcheting member 51*a* is engaged with the ratcheting disk 41. When the drive portion 31 is rotated in the second rotating direction, the ratcheting disk 41 is unrotatable, and relatively to the ratcheting drive portion 4 the main rotating body 3 is only rotatable in the second rotating direction. When the drive portion 31 is rotated in the first rotating direction, the ratcheting disk 41 is engaged with the first ratcheting member 51*a* to drive the main gear 42 to rotate. When the ratcheting drive portion 4 drives the rotating member 6 to rotate, the rotating member 6 continuously rotates and drives the claws 7 to come close to the central axis, so that the claws 7 clamp the oil filter tightly, and the oil filter is able to be removed.

As a conclusion, this invention of oil filter wrench includes the ratcheting disk, and by using driving and blocking functions of the ratcheting disk, it only needs to hold a tool and reciprocally rotate to disassemble the oil filter. The rotating members drive the claws to move close to or far away from the central axis to change the distance therebetween, and the oil filter is clamped.

Besides, after the oil filter wrench clamps the oil filter, the operator is able to reciprocally rotate the hand tool to release the oil filter and detach the oil filter from the oil filter container. There is no need to worry that the oil filter wrench is unable to clamp the oil filter when the hand tool is rotated reversely and the oil filter wrench has to be rotated to clamp the oil filter again. This disadvantage is improved.

While we have shown and described various embodiments in accordance with the present invention, it should be clear to those skilled in the art that further embodiments may be made without departing from the scope of the present invention.

What is claimed is:

1. An oil filter wrench, comprising:

a base, having an axis;

a main rotating body, rotatably assembled with the base, including a drive portion operable from outside;

a ratcheting drive portion, including a ratcheting disk rotatably mounted with the main rotating body and a main gear engaged with the ratcheting disk;

a limiting mechanism, including at least one ratcheting member movably disposed on the main rotating body, each ratcheting member including at least one tooth selectively engaged with the ratcheting disk;

at least three rotating members, pivoted to the base axially and arranged around the axis of the base, each of the rotating members including a passive gear portion engaged with the main gear, each passive gear portion being rotatable about a central axis;

at least three claws, connected to the rotating members and movable around corresponding central axis respectively;

wherein the main rotating body has a radial extent from the axis greater than a distance from the axis to each of the central axes, wherein relative to the axis, the main rotating body is eccentrically rotatably assembled on the base, and an end of the main rotating body extends radially beyond each of the central axes.

2. The oil filter wrench as claimed in claim 1, wherein the drive portion includes a polygonal protrusion or/and a polygonal concavity.

3. The oil filter wrench as claimed in claim 1, wherein the drive portion includes a radial through hole.

4. The oil filter wrench as claimed in claim 1, wherein the main rotating body further includes a housing formed with the drive portion, the ratcheting disk is disposed inside the housing and the main gear is disposed outside the housing, a portion of the base is disposed between the main gear and the housing, and the at least one ratcheting member is disposed on and inside the housing.

5. The oil filter wrench as claimed in claim 1, wherein the ratcheting drive portion includes a first assembling portion axially extending from the ratcheting disk, and the main gear is formed with a second assembling portion connected with the first assembling portion.

6. The oil filter wrench as claimed in claim 1, wherein each of the rotating members includes an arm radially extending from the passive gear portion, and each of the claws is connected to the corresponding arm.

7. The oil filter wrench as claimed in claim 1, wherein the limiting mechanism includes two the ratcheting members and a switching member, the two ratcheting members include a first ratcheting member and a second ratcheting member, the switching member is rotatably mounted to the main rotating body and formed with an abutting block between the first ratcheting member and the second ratcheting member, the switching member is pivoted between a first position and a second position, wherein while the switching member is located in the first position, the abutting block abuts against the first ratcheting member so that the first ratcheting member is unengaged with the ratcheting disk and the second ratcheting member is engaged with the ratcheting disk, and relatively to the ratcheting drive portion the main rotating body is only rotatable in a first rotating direction; while the switching member is located in the second position, the abutting block abuts against the second ratcheting member so that the second ratcheting member is unengaged with the ratcheting disk and the first ratcheting member is engaged with the ratcheting disk, and relatively to the ratcheting drive portion the main rotating body is only rotatable in a second rotating direction which is opposite to the first rotating direction.

8. The oil filter wrench as claimed in claim 1, wherein the limiting mechanism includes at least one first elastic member disposed between the main rotating body and the at least one ratcheting member.

9. The oil filter wrench as claimed in claim 1, wherein each of the claws is detachably connected to corresponding rotating member.

10. The oil filter wrench as claimed in claim 1, wherein each of the claws is formed with a plurality of long troughs.

* * * * *